US005547059A

United States Patent [19]

Watanabe et al.

[11] Patent Number: 5,547,059

[45] Date of Patent: Aug. 20, 1996

[54] LINEAR MOTOR ELEVATOR SYSTEM

[75] Inventors: Eiki Watanabe; Toshiaki Ishii; Masamoto Mizuno; Kazuhiko Sugita, all of Inazawa, Japan

[73] Assignee: Mitsubishi Denki Kabushiki Kaisha, Tokyo, Japan

[21] Appl. No.: 358,980

[22] Filed: Dec. 19, 1994

Related U.S. Application Data

[63] Continuation of Ser. No. 4,316, Jan. 14, 1993, abandoned.

[30] Foreign Application Priority Data

Jan. 16, 1992 [JP] Japan ..... 4-005883

[51] Int. Cl.[6] ..... B66B 7/00; B66B 11/00

[52] U.S. Cl. ..... 187/289; 187/411; 187/409; 187/288

[58] Field of Search ..... 187/289, 288, 187/277, 250, 251, 411, 409, 414; 310/12, 13

[56] References Cited

U.S. PATENT DOCUMENTS

| | | | |
|---|---|---|---|
| 5,033,587 | 7/1991 | Nakai et al. | 187/77 |
| 5,062,501 | 11/1991 | Pavoz et al. | 187/112 |
| 5,127,493 | 7/1992 | Yasuda et al. | 187/94 |
| 5,141,082 | 8/1992 | Ishii et al. | 187/110 |
| 5,203,430 | 4/1993 | Grinaski et al. | 187/17 |
| 5,203,432 | 4/1993 | Grinaski | 187/94 |

FOREIGN PATENT DOCUMENTS

| | | | |
|---|---|---|---|
| 48-58543 | 8/1973 | Japan . | |
| 63-117884 | 5/1988 | Japan . | |
| 1-271381 | 10/1989 | Japan | B66B 1/28 |
| 2-270789 | 11/1990 | Japan . | |
| 3-120179 | 3/1991 | Japan . | |
| 4-280780 | 4/1992 | Japan . | |
| 4-0412293 | 6/1992 | Japan | 187/112 |

*Primary Examiner*—Robert Nappi
*Attorney, Agent, or Firm*—Leydig, Voit & Mayer

[57] ABSTRACT

A linear motor elevator system comprising a sheave disposed in the upper portion of an elevator hoistway, a length of rope wound around the sheave, a movable member connected to said rope, a primary winding disposed only on a first side of said movable member and a secondary conductor extending within and along the hoistway in association with said primary winding to constitute a linear motor. The system may comprise a brake unit disposed on a second side of said movable member which is opposite to said first side and a guide rail disposed within said hoistway for being engaged by said brake unit.

8 Claims, 4 Drawing Sheets

LINEAR MOTOR ELEVATOR SYSTEM

This application is a continuation of application Ser. No. 08/004,316, filed Jan. 14, 1993 now abandoned.

BACKGROUND OF THE INVENTION

This invention relates to a rope-type elevator system and, more particularly, to a linear motor elevator system in which a linear motor is used for driving the elevator car.

FIG. 5 is a general schematic diagram of one example of a conventional linear motor elevator system disclosed in Japanese Patent Laid-Open No. 1-271381, FIG. 6 is a front view of a counter weight of the conventional linear motor elevator system illustrated in FIG. 5 and FIG. 7 is a plan view of a brake unit of the conventional linear motor elevator system illustrated in FIG. 5.

In FIGS. 5 to 7, the conventional elevator system comprises an elevator car 1 and a counter weight 4 connected by means of a rope 5 extending around sheaves 2 and 3. The details of the counter weight 4 are illustrated in FIGS. 6 and 7, in which the counter weight 4 is vertically movably supported within a hoistway defined by hoistway walls 6 by means of a pair of secondary conductors 7 of the linear induction motor. It is seen that the secondary conductors 7 are secured to the walls 6 through mounting brackets 8 so that they extend vertically at the opposite sides of the counter weight 4. The counter weight 4 includes a pair of primary windings 9 each of which constitutes a linear induction motor together with the respective secondary conductors 7. The counter weight 4 also includes a pair of brake units 10 each engageable with the respective secondary conductors 7. As best seen from FIG. 7, the brake unit 10 comprises a pair of brake arms 12 pivotable about a pin 11, brake shoes 13 attached to first ends of the brake arms 12, a compression spring 14 disposed between the second ends of the brake arms 12 and an electric magnet 17 including an iron core 15 and a coil 16 wound on the core 15 and disposed between the second ends of the brake arms 12.

When the primary windings 9 of the linear induction motors mounted on the counter weight 4 are energized, a thrust force is generated between the secondary conductors 7 and the primary windings 9 so that the counter weight 4 is driven by the thrust force along the secondary conductors 7. Since the counter weight 4 is connected to the elevator car 1 through the rope 5, the movement of the counter weight 4 is transmitted to elevator car 1 so that the latter is driven within the hoistway.

When the coil 16 of the electromagnet 17 is not energized, the spring force of the compression spring 14 causes the brake arms 12 to pivot about the pin 11 to sandwich the secondary conductor 7 between the brake shoes 13 under pressure, so that the brake unit 10 serves to maintain the counter weight 4 stand still. When the coil 16 of the electromagnet 17 is energized, the electromagnetic attractive force acting on the brake arms 12 overcomes the spring force 14 to move the brake shoes 13 away from the secondary conductor 7, whereby the brake unit 10 is released to allow the counter weight 4 to freely travel along the secondary conductor 7.

In the above-described conventional linear motor elevator, there are provided two sets of linear induction motors each including the secondary conductor 7 mounted on the opposite side walls 6 of the hoistway and the primary winding 9 associated with the respective secondary conductors 7. Therefore, the conventional linear motor elevator requires two secondary conductors 7 each on one side of the counter weight, significantly increasing the price of the linear motor elevator.

Also, since the brake unit 10 is disposed in association with the secondary conductor 7, the brake arm 12 must have a sufficiently large arm length W2 on the shoe side for accommodating a relatively large height dimension W1 of the secondary conductor 7 between two brake arms 12. Also, the brake arm 12 must be thick and rigid in order to accurately transmit the braking force from the compression spring 14 and the electromagnet 17. Therefore, the brake arms 12 and the entire brake unit 10 are large and heavy, expensive.

SUMMARY OF THE INVENTION

Accordingly, one object of the present invention is to provide a linear motor elevator system which is free from the above discussed problems of the conventional design.

Another object of the present invention is to provide a linear motor elevator system which is simple in structure and inexpensive.

Another object of the present invention is to provide a linear motor elevator system which requires a single secondary conductor.

A further object of the present invention is to provide a linear motor elevator system which has a compact brake unit.

With the above object in view, the linear motor elevator system of the present invention comprises a sheave disposed in the upper portion of an elevator hoistway, a length of rope wound around the sheave, a movable member connected to the rope, a primary winding disposed only on a first side of the movable member and a secondary conductor extending within and along the hoistway in association with the primary winding to constitute a linear motor.

The linear motor elevator system may comprise a brake unit disposed on a second side of the movable member which is opposite to the first side and a guide rail disposed within the hoistway for being engaged by the brake unit.

Alternatively, the linear motor elevator system of the present invention may comprise a field magnet and an armature disposed only on a first side of the movable member and a magnetic induction member extending within and along the hoistway in association with the primary winding to constitute a linear motor.

BRIEF DESCRIPTION OF THE DRAWINGS

The present invention will become more readily apparent from the following detailed description of the preferred embodiment of the present invention taken in conjunction with the accompanying drawings, in which.

DESCRIPTION OF THE PREFERRED EMBODIMENTS

Figure 1:
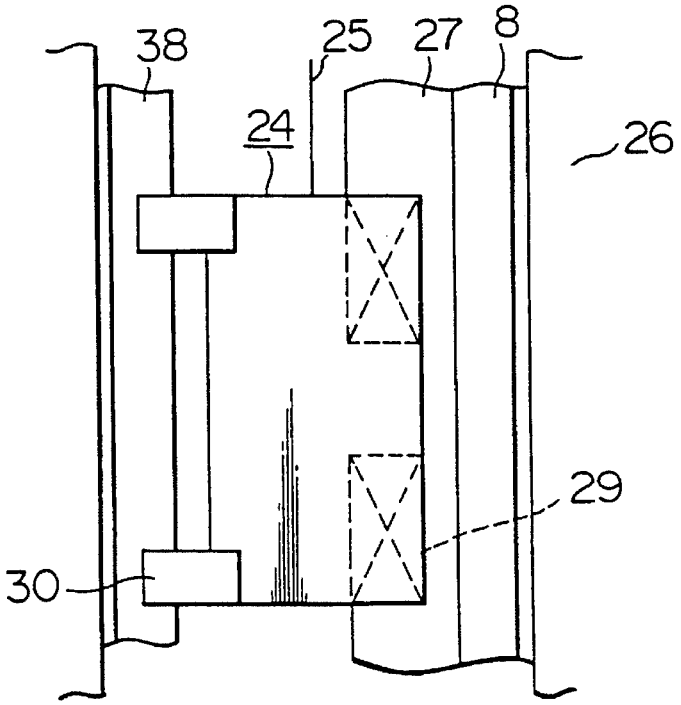
FIG. 1 is a schematic front view of the counter weight of one embodiment of the linear motor elevator system of the present invention.
Figure 2:
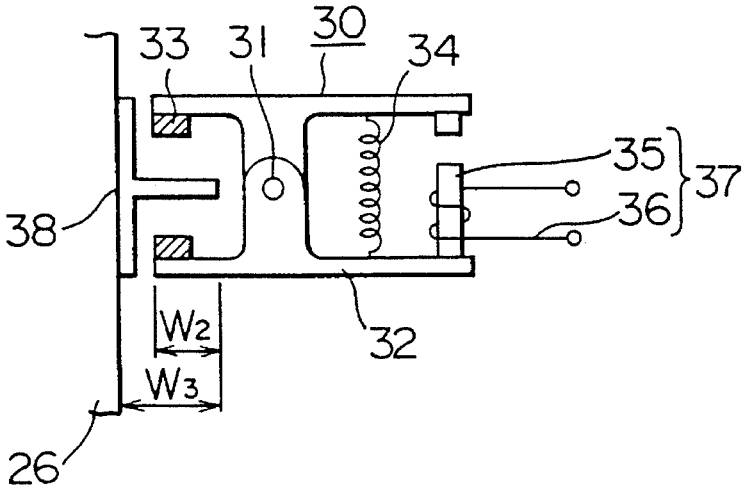
FIG. 2 is a schematic plan view of the brake unit of one embodiment of the linear more elevator system of the present invention.

FIG. 1 is a front view of a counter weight of a linear motor elevator system of the present invention and FIG. 2 is a plan view of a brake unit of the linear motor elevator system of the present invention. In these figures the same reference numerals designate the components identical or corresponding to those illustrated in FIGS. 5 to 7.

Figure 5:
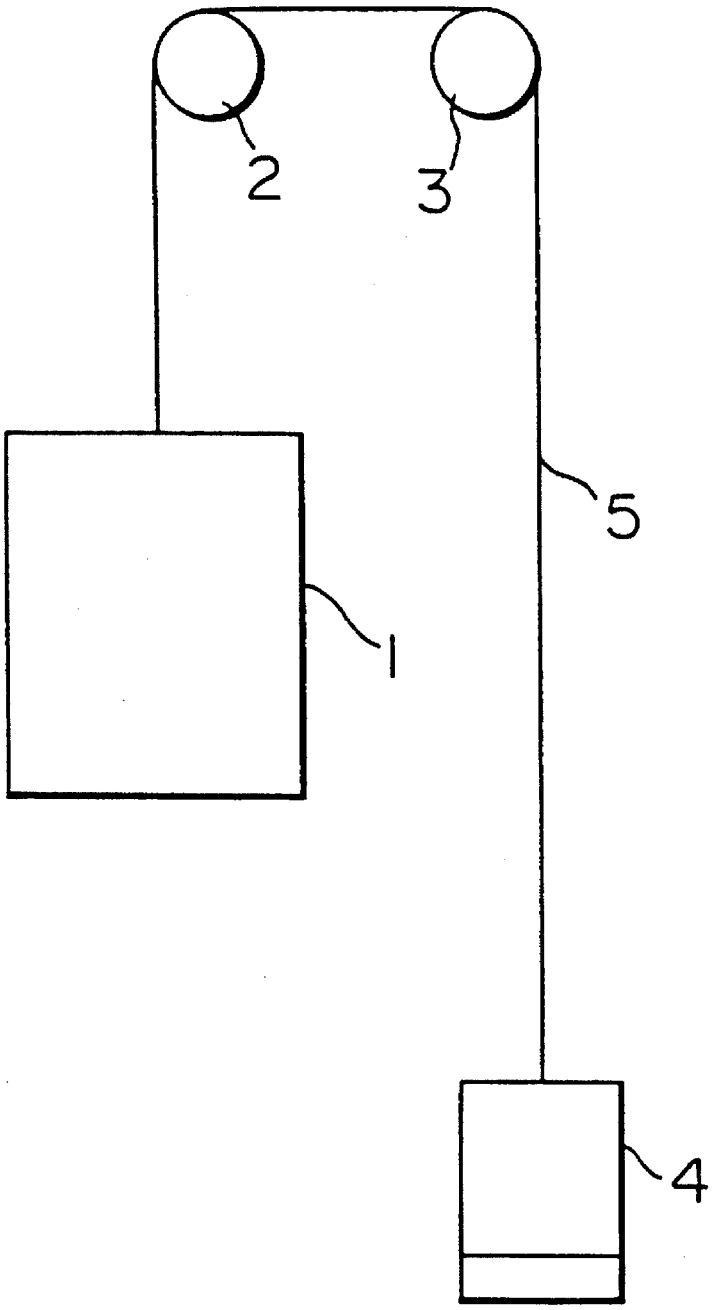
(PRIOR ART) FIG. 5
FIG. 5 is schematic general view of a conventional linear motor elevator system.
Figure 6:
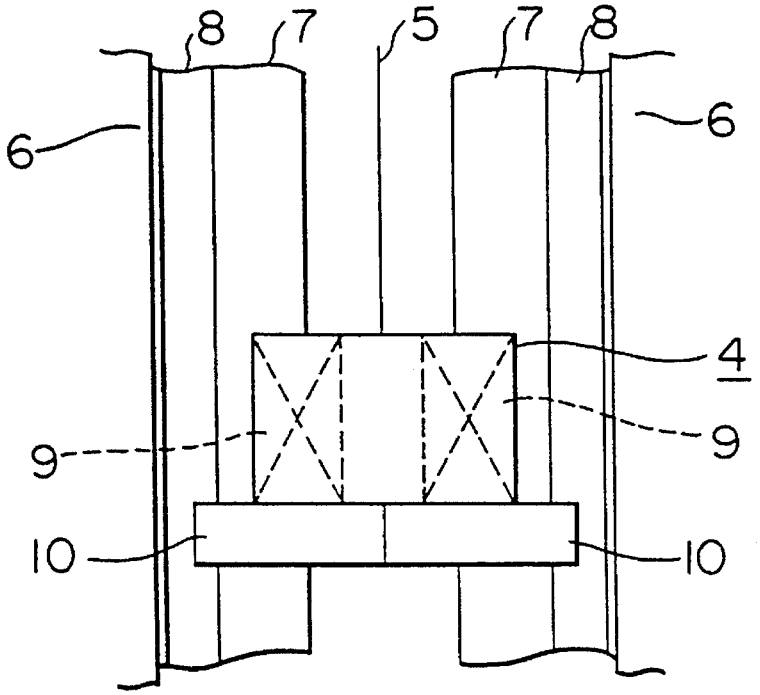
(PRIOR ART) FIG. 6
FIG. 6 is a schematic front view of the counter weight of the conventional linear motor elevator system of the present invention.

The elevator system comprises an elevator car (see FIG. 5) and a counter weight 24 connected by means of a rope 25 extending around sheaves (see FIG. 5). As illustrated in FIGS. 1 and 2, the counter weight 24 is vertically movably supported within a hoistway defined by hoistway walls 26 by means of a secondary conductor 27 of the linear induction motor. It is seen that only a single secondary conductor 27 is secured to the wall 26 through mounting brackets 8 so that it extends vertically only on a first side of the counter weight 24. The counter weight 24 includes a pair of primary windings 29 each of which constitutes a linear induction motor together with the single secondary conductor 27. It is seen that the pair of primary windings 29 are separated in a vertical direction in which the single secondary conductor 27 extends.

The counter weight 24 also includes a pair of brake units 30 on a second side thereof opposite to the first side on which the primary windings 29 are disposed. The brake units 30 are vertically separated from each other and engageable with a guide rail 38 disposed within and extending along the hoistway in parallel to the secondary conductor 27. As best seen from FIG. 2, each of the brake units 30 comprises a pair of brake arms 32 pivotable about a pin 31 secured to the counter weight 24. A brake shoe 33 is attached to a first end of each brake arms 32. A compression spring 34 disposed between the second ends of the brake arms 32 and an electric magnet 37 including an iron core 35 and a coil 36 wound on the core 35 is also disposed between the second ends of the brake arms 32.

When the primary windings 29 of the linear induction motors mounted on the counter weight 24 are energized, a thrust force is generated between the secondary conductor 27 and the primary windings 29 so that the counter weight 24 is driven by the thrust force along the secondary conductor 27, whereby the elevator car is driven within the hoist way.

When the coil 36 of the electromagnet 37 is not energized, the spring force of the compression spring 34 causes the brake arms 32 to pivot about the pin 31 to sandwich guide rail 38 between the brake shoes 33 under pressure, so that the brake unit 30 serves to maintain the counter weight 24 at a stand still. When the coil 36 of the electromagnet 37 is energized, the electromagnetic attractive force acting on the brake arms 32 overcomes the spring force to move the brake shoes 33 away from the guide rail 38, whereby the brake unit 30 is released to allow the counter weight 24 to freely travel along the secondary conductor 27.

According to this embodiment, since the pair of primary windings 29 disposed only on the first side of the counter weight 24 are associated with the single, common secondary conductor 27, only a single secondary conductor 27 is needed on one side of the hoistway to generate an electromagnetic thrust force substantially equal to that obtained with the conventional design in which two secondary conductors 27 are used. Also, the price of the elevator system can be greatly reduced.

Figure 7:
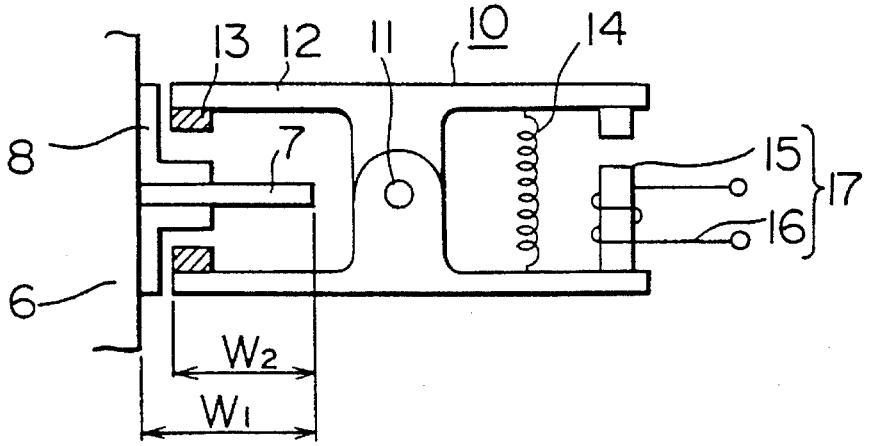
(PRIOR ART) FIG. 7
FIG. 7 is a schematic plan view of the brake unit of the conventional linear motor elevator system of the present invention.

Also, since the brake units 30 engage the guide rail 38 which has a height dimension W3 shorter than the height dimension W1 of the secondary conductor 7 of the conventional design, the length W2 of the brake arm 32 can be made much shorter than the brake arm 12 of the conventional design shown in FIG. 7 and equal to a length sufficient only for accommodating the height dimension W3 of the guide rail 38. Also, the rigidity of the brake arm 32 can be obtained without the need for particularly increasing the thickness or weight of the brake arm 32 because of its relatively short length. Therefore, the overall dimension and the weight of the brake unit 30 can be significantly decreased.

While the primary windings 29 of the linear induction motor are mounted on the counter weight 24 in the above-described embodiment, it is apparent that similar advantageous results can be obtained by mounting the primary windings 29 of the linear induction motor on an elevator car.

Figure 3:
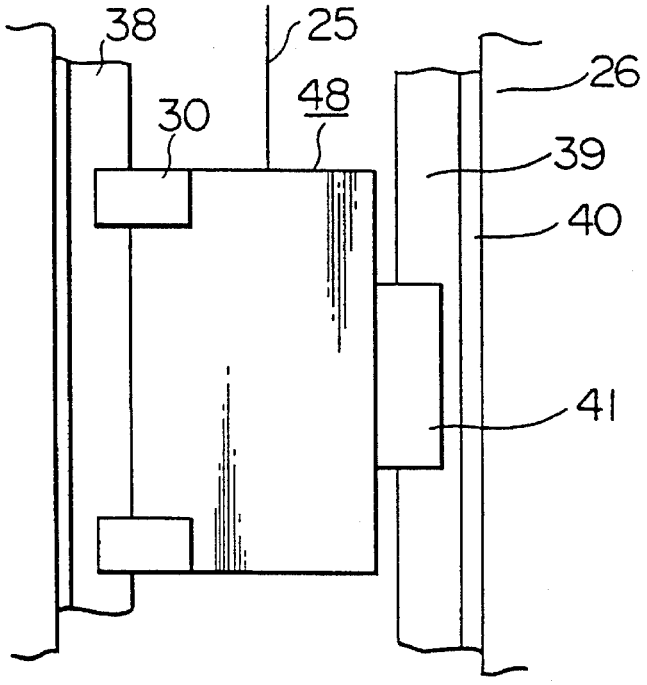
FIG. 3 is a schematic front view of the counter weight of another embodiment of the linear motor elevator system of the present invention.
Figure 4:
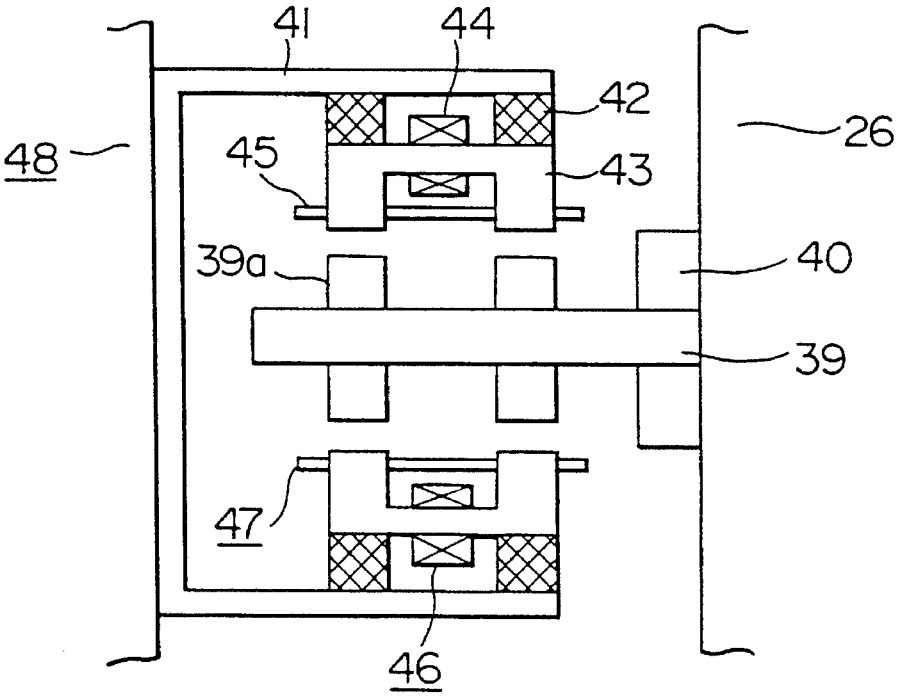
FIG. 4 is a schematic plan view of the brake unit of another embodiment of the linear motor elevator system of the present invention.

FIGS. 3 and 4 illustrate another embodiment of the linear motor elevator system of the present invention in which the present invention is applied to an induction-type linear synchronous motor elevator system. From FIG. 3 which is a schematic front view of a counter weight 48, it is seen that the counter weight 48 has mounted only on a first side thereof a mounting bracket 41 of a substantially U-shaped cross section on which a field magnets 46 and armatures 47 are mounted as best seen in FIG. 4. It is also seen that a single elongated magnetic induction member 39 is secured to the hoistway by means of a bracket 40 in order that a linear induction motor for driving the movable member of the elevator system is constituted between the first side of the counter weight 48 and the hoistway. As best seen in FIG. 4 the magnetic induction member 39 comprises a rigid elongated magnetic plate having a plurality of magnetic pole pieces **39*a* disposed in rows on both sides of the magnetic plate. Each leg portion of the U-shaped mounting bracket 41 has secured thereon an iron core 43 by means of non-magnetic plates 42, and the iron core 43 has mounted thereon a field winding 44 and an armature coil 45. The iron core 43 and the field winding 44 together constitute-a field magnet 46 and the iron core 43 and the armature winding 45 constitute an armature 47, so that the induction member 39, the field magnet 46 and the armature 47** together constitute a linear synchronous motor.

As has been described, the linear motor elevator system of the present invention comprises a movable member having a first side and disposed within a hoistway and a linear motor disposed between only on the first side of the movable member and the hoistway for generating a magnetic drive force for moving the movable member along the hoistway. Therefore, the linear motor elevator system of the present invention requires only a single secondary conductor or a single induction member disposed on one side of the movable member, whereby structure and assembly of the elevator become simple and the price of the linear motor elevator system can be significantly decreased.

Also, since the brake unit can be disposed in association with the guide rail having a relatively low height, the brake arm needs not have a large arm length for accommodating a relatively large height dimension of the secondary conductor or the induction member and a large thickness and rigidity. Therefore, the entire brake unit can be made compact, light-weight and less expensive.

What is claimed is:

1. A linear motor elevator system for driving an elevator car in a hoistway which has first and second opposing walls, said system comprising:

a movable body having a first side and a second side opposing the first side, the movable body being disposed in the hoistway such that the first side of the movable body opposes the first wall of the hoistway and the second side of the movable body opposes the second wall of the hoistway;

one and only one magnetic induction member, said one and only one magnetic induction member being disposed along the first wall of the hoistway;

a bracket having first and second legs opposing said magnetic induction member, said bracket being disposed only on the first side of said movable body;

means for generating a magnetic drive force for moving said movable member along said hoistway, said means for generating being secured to each leg of said bracket; and a brake unit disposed only on the second side of the movable body.

2. A linear motor elevator system comprising:

a movable body having first and second opposing sides, said movable body being disposed in a hoistway;

first and second primary windings disposed on a first side of said movable body, the first and second primary windings being separated from each other;

a brake unit disposed on said movable body, said brake unit including first and second pivotable brake arms and an arm actuating mechanism to facilitate pivoting of the first and second brake arms, said brake unit being arranged such that the first and second brake arms extend in a direction perpendicular to the second side of said movable body and is without primary windings.

3. A linear motor elevator system comprising:

a sheave disposed in the upper portion of an elevator hoistway;

a rope wound around the sheave;

a movable body disposed in the elevator hoistway, said movable body having first and second sides;

one and only one driving device defined by a field magnet and an armature, the driving device being disposed only on the first side of said movable body;

a magnetic induction member extending within and along the hoistway facing the first side of said movable body and positioned between the field magnet and the armature;

a brake unit disposed on the second side of said movable body, the second side being opposite to the first side, wherein the brake unit includes first and second pivotable brake arms and an actuating mechanism to facilitate pivoting of the first and second arms, said brake unit being arranged such that the first and second brake arms extend in a direction perpendicular to the second side of said movable body; and a guide rail disposed within said hoistway facing the second side of said movable body for engagement with said brake unit.

4. A linear motor elevator system as claimed in claim 1 further comprising a guide rail disposed along only the second wall of the hoistway, whereby the first wall of the hoistway has a magnetic induction member disposed thereon without a guide rail and the second wall of the hoistway has a guide rail disposed thereon without a magnetic induction member.

5. A linear motor elevator system as claimed in claim 4 wherein the magnetic induction member includes an elongated magnetic plate having a plurality of magnetic pole pieces disposed in rows.

6. A linear motor elevator system as claimed in claim 4 wherein the brake unit includes a pair of brake arms and means for clasping the brake arms to said guiderail.

7. A linear motor elevator system as claimed in claim 2 wherein the first and second windings are separated in a direction in which said secondary conductor extends.

8. The linear motor elevator system of claim 2 wherein the brake unit is disposed on the second side of the movable body.

* * * * *